United States Patent [19]

Bampfield

[11] Patent Number: 4,470,855

[45] Date of Patent: Sep. 11, 1984

[54] WATER-IN-WAX EMULSION BLASTING AGENTS

[75] Inventor: Howard A. Bampfield, Otterburn Park, Canada

[73] Assignee: C-I-L Inc., North York, Canada

[21] Appl. No.: 583,624

[22] Filed: Feb. 27, 1984

[30] Foreign Application Priority Data

Apr. 21, 1983 [CA] Canada ..... 426413

[51] Int. Cl.[3] ..... C06B 45/02

[52] U.S. Cl. ..... 149/2; 149/21; 149/41; 149/46; 149/60; 149/61; 149/83; 149/85

[58] Field of Search ..... 149/2, 21, 41, 46, 60, 149/61, 83, 85

[56] References Cited

U.S. PATENT DOCUMENTS

| | | | |
|---|---|---|---|
| 4,216,040 | 8/1980 | Sudweeks et al. | 149/60 X |
| 4,231,821 | 11/1980 | Sudweeks et al. | 149/61 X |
| 4,322,258 | 3/1982 | Sudweeks et al. | 149/61 X |
| 4,357,184 | 11/1982 | Binet et al. | 149/60 X |
| 4,404,050 | 9/1983 | Yorke et al. | 149/61 X |
| 4,420,349 | 12/1983 | Bampfield | 149/61 X |

*Primary Examiner*—Stephen J. Lechert, Jr.
*Attorney, Agent, or Firm*—Donald G. Ballantyne

[57] ABSTRACT

A water-in-wax emulsion explosive composition is provided wherein the continuous carbonaceous fuel phase comprises paraffin wax together with a minor amount of a rheology modifier and stabilizer combination comprising an ethylene-containing polymer and a low molecular weight hydrocarbon liquid. The resulting explosive composition exhibits properties of viscosity and stability comparable to similar compositions containing highly refined microcrystalline wax fuels.

11 Claims, No Drawings

WATER-IN-WAX EMULSION BLASTING AGENTS

The present invention relates to water-in-fuel emulsion explosive compositions which consist of a continuous carbonaceous fuel phase which is external, and a discontinuous aqueous oxidizing salt solution phase which is internal. In particular, the invention relates to such emulsion explosive compositions containing paraffin wax as the carbonaceous fuel phase which is advantageous over similar types of fuels disclosed in the prior art.

Water-in-oil and water-in-wax emulsion explosives are now well known in the explosives art and have been demonstrated to be safe, economic and simple to manufacture and to yield excellent blasting results. Bluhm, in U.S. Pat. No. 3,447,978, discloses an emulsion explosive composition comprising an aqueous discontinuous phase containing dissolved oxygen-supplying salts, a carbonaceous fuel continuous phase, an occluded gas and an emulsifier. Since Bluhm, further disclosures have described improvements and variations in water-in-oil explosive compositions. These include U.S. Pat. No. 3,674,578, Cattermole et al.; U.S. Pat. No. 3,770,522, Tomic; U.S. Pat. No. 3,715,247, Wade; U.S. Pat. No. 3,765,964, Wade; U.S. Pat. No. 4,110,134, Wade; U.S. Pat. No. 4,149,916, Wade; U.S. Pat. No. 4,141,817, Wade; U.S. Pat. No. 4,141,767, Sudweeks & Jessup; Canadian Pat. No. 1,096,173, Binet and Seto; U.S. Pat. No. 4,111,727, Clay; U.S. Pat. No. 4,104,092, Mullay; U.S. Pat. No. 4,231,821, Sudweeks & Lawrence; U.S. Pat. No. 4,218,272, Brockington; U.S. Pat. No. 4,138,281, Olney & Wade; U.S. Pat. No. 4,216,040, Sudweeks & Jessup; and U.S. Pat. No. 4,287,010, Owen. In Canadian Pat. No. 1,106,835, Bent et al and in U.S. Pat. Nos. 4,259,977, Brockington and 4,273,147, Olney, methods are disclosed for the preparation and placement of emulsion explosive compositions.

All of the aforementioned emulsion type explosive compositions contain an essential emulsifier ingredient. Without the presence of such an emulsifier, the mixed phases of the compositions tend to separate to form a layered mixture which has no utility as an explosive.

Additionally, all of the aforementioned compositions contain as the carbonaceous fuel, a fluidizable carbonaceous ingredient in a substantially refined or purified state. For example, U.S. Pat. No. 4,231,821 discloses the use of materials selected from mineral oil, waxes, paraffin oils, benzene, toluene, xylenes and mixtures of liquid hydrocarbons generally referred to as gasoline, kerosene and diesel fuels. U.S. Pat. No. 4,218,272 discloses the use of highly refined microcrystalline waxes, for example, WITCO (Reg. TM) X145-A and ARISTO (Reg. TM) 143. In U.S. Pat. No. 4,110,134, the use is proposed of INDRA (Reg. TM) 2119, a substantially refined blend of petrolatum, wax and oil and ATREOL (Reg. TM), a white mineral oil. The use of such refined or purified carbonaceous material as the continuous fuel phase of an emulsion explosive composition has heretofore been deemed essential.

When the carbonaceous fuel phase comprises a liquid which is flowable at or slightly above ambient temperatures, for example, mineral oil, paraffin oil, diesel fuel oil and the like, the resultant emulsion explosives are generally of a viscous lliquid nature and are not normally suitable for packaging using conventional explosives packaging or cartridging apparatus. They may also be too liquid for use for the bulk-loading of unlined boreholes since the compositions tend to escape into fissures in the borehole rock wall. The addition of a microcrystalline wax to the carbonaceous fuel phase produces an emulsion of high viscosity suitable for packaging but, in addition to their high cost, the microcrystalline waxes create manufacturing problems because of their high melt viscosity. Emulsion explosives containing microcystalline waxes remain very viscous even at elevated process temperatures and hence cause great difficulties in blending, pumping, packaging and other manufacturing operations.

According to the present invention, a water-in-wax emulsion explosive composition is provided wherein the continous carbonaceous fuel phase comprises paraffin wax together with a minor amount of a stabilizer/-rheology modifier combination comprising an ethylene-containing polymer and a low molecular weight hydrocarbon liquid.

It has been found that readily available and inexpensive paraffin wax, together with minor amounts of a rheology modifier and stabilizer combination comprising an ethylene-containing polymer and a hydrocarbon liquid, may be used to replace the previously employed highly refined microcrystalline waxes in emulsion explosive compositions. Unlike the microcrystalline waxes, paraffin wax melts sharply at relatively low process temperature to form a low viscosity liquid which is readily emulsified with an aqueous salt solution. The resultant emulsion explosive mixture is conveniently pumped and packaged, and upon cooling, forms a pasty or putty-like semi-solid of desired cartridged explosives characteristics. In addition, the water-in-paraffin emulsion explosive of the invention displays long term stability, together with a high degree of initiation sensitivity.

The paraffin wax employed as the continuous fuel phase of the emulsion explosive composition of the present invention comprises any commercially available product derived from the wax-distillate fraction of crude petroleum ranging from a yellow crude scale wax characterized (ASTM) by melt point temperature (mpt) 50°–51° C. to a purified grade having an mpt 53°–54° C.

The ethylene-containing polymer comprising part of the rheology/stabilizer combination is any ethylene homopolymer or any ethylene/vinyl acetate copolymer wherein the content of vinyl acetate does not exceed 30%. The ethylene-containing polymers suitable for use in the present invention are characterised by a molecular weight of between 1000 and 3000 and are appreciably soluble in molten paraffin wax to the extent that the cloud point of a 5% solution of the polymer in paraffin wax is greater than the temperature of formation of the emulsion. By "cloud point" is meant the temperature at which the polymer starts to precipitate from solution in molten paraffin when cooled under standard conditions.

The hydrocarbon liquid comprising part of the rheology/stabilizer combination is any paraffinic or refined saturated hydrocarbon (alkane) solvent having carbon atom chain lengths up to C35. Preferred are those of chain lengths C8–C16. Particularly suitable are members of the series selected from the group of octane, dodecane and hexadecane.

The emulsion explosive composition of the invention comprises: (a) a continuous phase of from 1–10% by weight of commercial grade paraffin wax, from 0.5–3% by weight of an emulsifying agent, 0.3–2.5% by weight of a rheology/stabilizer combination comprising 0.2–1.5% by weight of an ethylene-containing polymer and from 0.1–1% by weight of a hydrocarbon liquid; (b) a discontinuous phase of from 10–25% by weight of water and from 65–85% by weight of soluble inorganic oxygen-supplying salts; and (c) a discontinuous sensitizer phase of a sufficient amount of a density lowering ingredient to maintain the composition at a density between 0.9 and 1.4 g/cc.

The discontinuous aqueous component or phase of the emulsified explosive will have a dissolved inorganic oxygen-supplying salt therein. Such an oxidizer salt will generally be ammonium nitrate but up to 50% by weight of the ammonium nitrate can be replaced by one or more other inorganic salts, such as, for example, the alkali or alkaline earth metal nitrates or perchlorates.

Typical of emulsifiers suitable for use in the composition are the monomeric emulsifiers, such as, the saturated fatty acids and fatty acid salts, glycerol stearates, esters of polyethylene oxide, fatty amines and esters, polyvinyl alcohol, sorbitan esters, phosphate esters, polyethylene glycol esters, alkylaromatic sulphonic acids, amides, triethanolamine oleate, amine acetate, imidazolines, unsaturated fatty chain oxazolines, and mercaptans. Among the polymeric emulsifiers which may be employed are the alkyds, ethylene oxide/propylene oxide copolymers and hydrophobe/hydrophil block copolymers. Also suitable is an emulsifier which is the reaction product of glycerol and a dimer acid. In some cases, mixtures or blends of emulsifiers are used. The emulsifier chosen will be the one which functions most expeditiously in the environment of the emulsion explosive being formulated.

Additionally, the emulsion explosive of the invention may contain optional additional fuel, sensitizer or filler ingredients, such as, for example, glass or resin microspheres, particulate light metal, void-containing material, such as, styrofoam beads or vermiculite, particulate carbonaceous material, for example, gilsonite or coal, vegetable matter, such as, ground nut hulls or grain-hulls, sulfur and the like.

Air or gas bubbles, for density modification and sensitization purposes, may be injected or mixed into the emulsion composition or may be generated in situ from a gas generating material, such as, peroxide or sodium nitrate.

The emulsion explosives of the present invention are, preferably, made by preparing a first premix of water and inorganic oxidizer salt and a second premix of paraffin wax fuel, emulsifying agent and rheology/stabilizer combination. The aqueous premix is heated to ensure dissolution of the salts and the fuel premix is heated to provide liquidity. The premixes are blended together and emulsified in a mechanical blade mixer, rotating drum mixer or by passage through an in-line static mixer. Thereafter, the density lowering material, for example, glass microspheres, are added along with any auxiliary fuel and the final product packaged into suitable cartridges or containers.

The water-in-wax emulsion explosive compositions of the present invention are sensitive to initiation by blasting cap in small diameter (2.5 cm.) charges at ambient temperatures. The compositions display excellent storage properties and show no signs of demulsification, retaining cap sensitivity after being subjected to a series of temperature cycles of −17° C. to +35° C.

The following Examples and Tables described the preparation and measurement of properties of the water-in-wax emulsion explosives of the invention.

EXAMPLES 1–26

A series of twenty-six water-in-wax emulsion explosive compositions were prepared wherein the proportion of ingredients are as shown below, all parts being expressed as percentage by weight:

| | |
|---|---|
| Ammonium nitrate | 60.6 |
| Sodium nitrate | 14.7 |
| Calcium nitrate | 4.6 |
| Water | 11.9 |
| Fuel | 4.2 |
| Emulsifier | 1.7 |
| Glass microspheres | 2.3 |

The emulsifier consisted of a blend of 0.3% of a polymer emulsifier, 0.7% of sorbitan sesqui-oleate and 0.7% of soya lecithin. The fuel component comprised paraffin wax (ASTM 52°–54° C.) to which was added varying amounts and concentrations of different ethylene-containing polymers and hydrocarbon liquids. After preparation, the warm explosives having a grease-like liquid form were packaged by injecting the compositions into 25 mm cyclindrical paper cartridges where it cooled to putty-like consistency. The cartridges were initiated by means of various strengths blasting caps to determine the minimum priming required to achieve detonation.

Table I, below, shows a series of compositions containing different ethylene-containing polymers and a hydrocarbon liquid. The minimum strength primer required to achieve detonation of a 25 mm cartridge is shown.

TABLE I

| MIX NO. | POLYMER | AMOUNT | HC LIQUID | AMOUNT | MIN. PRIMER** (as made) |
|---|---|---|---|---|---|
| 1 | Vybar* 253 [1] | 0.5 | HT-22* [7] | 0.15 | R-8 |
| 2 | Vybar 260 [2] | 0.5 | " | 0.2 | R-7 |
| 3 | Vybar 103 [3] | 0.5 | " | 0.2 | R-9 |
| 4 | AC*-617 [4] | 0.5 | " | 0.1 | R-9 |
| 5 | AC-400 [5] | 0.5 | " | 0.1 | R-9 |
| 6 | AC-430 [6] | 0.5 | " | 0.1 | R-10 |
| 7 | Nil | — | " | 0.1 | R-15 |

TABLE I-continued

| MIX NO. | POLYMER | AMOUNT | HC LIQUID | AMOUNT | MIN. PRIMER** (as made) |
|---|---|---|---|---|---|
| 8 | Nil | — | Nil | — | F (E.B.) |

Ethylene homopolymer mol. wt. 1475
Ethylene homopolymer mol. wt. 1575
Ethylene homopolymer mol. wt. 1725
Ethylene homopolymer mol. wt. 1500
Ethylene/14% vinylacetate
Ethylene/26% vinylacetate
Mixed C25–C35 hydrocarbons
*Reg. TM
**Caps designated R-n contain 0.1 g initiating composition and (n-3) × 0.05 g PETN 13 ≧ n ≧ 4 or (n − 13) × 0.1 + 0.5 g PETN 16 ≧ n ≧ 14 base charge. E.B. indicates electric blasting caps containing .08 g initiating composition and .78 g PETN. F indicates a failure to detonate. All properties were measured at 5° C.

The results shown in Table I demonstrate that the addition of ethylene-containing polymer and hydrocarbon liquid increases the sensitivity of the compositions to initiation while retaining a putty-like consistency. The absence of polymer (Mix 7) results in loss of some sensitivity and the absence of both polymer and hydrocarbon liquid (Mix 8) results in appreciable loss in sensitivity.

Table II, below, shows the result of primer initiation of several of the mixes of Table I after accelerated storage or temperature cycling.

TABLE II

| MIX NO. | INITIAL PRIMER | AFTER 2 CYCLES* (V.O.D. Km/s) | | AFTER 4 CYCLES* (V.O.D. Km/s) | |
|---|---|---|---|---|---|
| 1 | R-8 | E.B. | (4.3) | — | — |
| 2 | R-7 | R-15 | (4.2) | — | — |
| 3 | R-9 | E.B. | (Fail) | — | — |
| 4 | R-9 | — | — | E.B. | (3.9) |
| 7 | R-15 | E.B. | (Fail) | — | — |
| 8 | E.B. (Failed) | — | — | — | — |

*One cycle is an excursion −17→+35→−17° C. with 48 hours at each temperature.

From the results in Table II, it can be seen that after accelerated storage, the mixes containing the rheology/stabilizer combination retained the greater degree of sensitivity.

Table III, below, shows the sensitivity of a series of mixes wherein the quantity of ethylene polymer employed is increased to 0.7% and the liquid hydrocarbon components chosen ranged in carbon chain length from $C_8$ to $C_{16}$. In addition, the amount of liquid hydrocarbon used was increased to 0.3%.

TABLE III

| MIX NO. | POLYMER | % | LIQUID COMPONENT | % |
|---|---|---|---|---|
| 9 | Vybar 253 | 0.7 | HT-22 | 0.3 |
| 10 | Vybar 253 | 0.7 | Octane | 0.3 |
| 11 | Vybar 253 | 0.7 | Dodecane | 0.3 |
| 12 | Vybar 253 | 0.7 | Hexadecane | 0.3 |
| 13 | Vybar 253 | 0.5 | Dodecane | 0.2 |
| 14 | Vybar 103 | 0.7 | Octane | 0.3 |
| 15 | Vybar 103 | 0.5 | Dodecane | 0.2 |
| 16 | Vybar 103 | 0.7 | Hexadecane | 0.3 |
| 17 | Vybar 260 | 0.5 | Dodecane | 0.2 |
| 18 | Vybar 260 | 0.7 | Octane | 0.3 |
| 19 | Vybar 260 | 0.7 | Hexadecane | 0.3 |
| 20 | AC-617 | 0.7 | Octane | 0.3 |
| 21 | AC-617 | 0.7 | Dodecane | 0.3 |
| 22 | AC-617 | 0.7 | Hexadecane | 0.3 |
| 23 | AC-400 | 0.7 | Octane | 0.3 |
| 24 | AC-400 | 0.7 | Dodecane | 0.3 |
| 25 | AC-400 | 0.7 | Hexadecane | 0.3 |
| 26 | Nil | 0.7 | Dodecane | 0.3 |

MINIMUM PRIMER

TABLE III-continued

| MIX NO. | INI-TIAL | NO. OF CYCLES | MIN. PRIMER | V.O.D. |
|---|---|---|---|---|
| 9 | R-8 | 2 | R-13 | 4.3 |
| 10 | R-9* | 4 | R-9 | 4.5 |
| 11 | R-8* | 4 | R-11 | 4.4*** |
| 12 | R-9* | 4 | R-9 | 4.5 |
| 13 | R-9* | 2 | R-11 | 4.5 |
| 14 | R-8** | 4 | E.B. | Fail |
| 15 | R-7 | 2 | E.B. | Fail |
| 16 | R-9* | 4 | E.B. | Fail |
| 17 | R-8 | 3 | R-9 | 4.1 |
| 18 | R-9** | 4 | E.B. | 2.7 |
| 19 | R-8* | 4 | R-8 | 4.6 |
| 20 | R-8** | 4 | E.B. | Fail |
| 21 | R-8* | 4 | R-15 | 3.7 |
| 22 | — | 4 | R-16 | 2.7 |
| 23 | R-9** | 4 | E.B. | Fail |
| 24 | R-7* | 4 | R-16 | 4.3 |
| 25 | R-7 | 4 | R-13 | 4.6 |
| 26 | E.B. | 2 | E.B. | Fail |

*Minimum Primer after one cycle
**After two cycles
***This compositon remains sensitive to E.B. initiation after 12 months ambient storage.

From the results shown in Table III, the following observations can be made. An increase in the amount of ethylene-containing polymer from 0.5% (Table I) to 0.7% results in a more stable product, that is, sensitivity is improved over the Table II results after accelerated storage. The use of a lower molecular weight liquid hydrocarbon in greater amount increases stability markedly. Both homopolymers and copolymers of ethylene are useful for purposes of the invention. There is a synergistic relationship between ethylene-containing polymers and low molecular weight hydrocarbon liquids. Compare Mix. No. 9 with Mix Nos. 10–12 where the latter mixes demonstrating improved sensitivity (and stability) all contain a low molecular weight liquid.

EXAMPLES 27–32

A series of emulsion explosive compositions were prepared having proportions of ingredients identical to those described in Examples 1–26 except that a variety of fuel phase components were employed. The amount or degree of coagulation or viscosity of each composition was measured under both hot and cold conditions in accordance with ASTM Test No. B217/68 normally employed for testing greases and waxes. (See Annual Book of ASTM Standard, Vol. 23, 1978, page 133). Additional viscosity measurements (Brookfield viscosity) were also performed on some samples. The results of tests performed on compositions containing prior art fuel ingredients and on compositions containing the fuel ingredients of the present invention are shown in Table IV, below:

TABLE IV

| MIX NO. | FUEL PHASE | PENETRATION RANGE HOT[1] | PENETRATION RANGE COLD[2] | VISCOSITY[3] cp (72–75° C.) |
|---|---|---|---|---|
| 27 | Crude Petroleum wax/paraffin wax[4] | 310–332 | 128 ± 1 | — |
| 28 | Microcrystalline wax | 305–272 | 160 ± 2 | — |
| 29 | Paraffin oil/paraffin wax/microcrystalline wax[5] | 311–322 | — | — |
| 30 | Paraffin wax/paraffin oil[6] | — | 165 ± 1 | 50,000 |
| 31 | Paraffin wax/dodecane/Vybar 253[7] | 356–371 | 72–135 | 42,000 |
| 32 | Crude petroleum wax/microcrystalline wax[6] | — | 142 ± 4 | 140,000 |

[1] 77–84°
[2] 20–25° C.
[3] Brookfield spindle #7 @ 10 rpm
[4] Ratio 1/1
[5] Ratio 0.91/1.91/1.91
[6] Ratio 3.2/0.3/0.7
[7] Ratio 3.2/0.3/0.7

From the results in Table IV, it can be seen that Mix 31 comprising the paraffin wax/ethylene-containing polymer/hydrocarbon liquid fuel phase of the present invention demonstrates in the hot range a greater penetration and a lower viscosity than the sample mixes containing conventional prior art fuel combinations. In addition, the cold range penetration of Mix 31 is substantially less than the other sample mixes. Thus, the composition of the invention is shown to have superior processability properties when warm yet sets up in a highly viscous state upon cooling to ambient temperatures.

I claim:

1. A water-in-oil emulsion explosive composition having a density of from 0.9–1.4 g/cc comprising a continuous carbonaceous fuel phase, a discontinuous oxidizer salt aqueous solution phase, and an emulsifier, the said carbonaceous fuel phase comprising a major amount of a commercial grade paraffin wax having a metal point temperature of from 50° to 54° C. and a minor amount of rheology modifier/stabilizer combination, which combination comprises an ethylene-containing polymer and a low molecular weight hydrocarbon liquid.

2. An explosive composition as claimed in claim 1 wherein the oxidizer salt is ammonium nitrate.

3. An explosive composition as claimed in claim 2 wherein up to 50% by weight of the ammonium nitrate is replaced by one or more inorganic salts selected from the group of alkali and alkaline earth metal nitrates and perchlorates.

4. An explosive composition as claimed in claim 1 wherein the ethylene-containing polymer comprises ethylene homopolymers and ethylene/vinyl acetate copolymers wherein the vinyl acetate does not exceed 30% by weight.

5. An explosive composition as claimed in claim 4 wherein the said ethylene-containing polymer has a molecular weight between 1000 and 3000, is soluble in paraffin oil and has a 5% paraffin wax solution cloud point which is greater than the temperature of formation of the emulsion.

6. An explosive composition as claimed in claim 1 wherein the low molecular weight hydrocarbon liquid comprises an alkane solvent having carbon atom chain lengths up to C35.

7. An explosive composition as claimed in claim 6 wherein the hydrocarbon liquid alkane has a carbon atom chain length from C6 to C16.

8. An explosive composition as claimed in claim 1 wherein the emulsifier is selected from the group of saturated fatty acids and fatty acid salts, glycerol stearates, esters of polyethylene oxide, fatty amines and esters, polyvinyl alcohol, sorbitan esters, phosphate esters, polyethylene glycol esters, alkylaromatic sulphonic acids, amides, triethanolamine oleate, amine acetate, imidazolines, unsaturated fatty chain oxazolines, mercaptans; polymeric emulsifiers comprising alkyds, ethylene oxide/propylene oxide copolymers and hydrophobe/hydrophil block copolymers and the reaction product of glycerol and a dimer acid and mixtures thereof.

9. An emulsion explosive composition comprising (a) a continuous phase comprising from 1–10% by weight of commercial grade paraffin wax, from 0.5–3% by weight of an emulsifier and from 0.3–2.5% by weight of a rheology/stabilizer combination consisting of from 1.2–1.5% by weight of an ethylene-containing polymer and from 0.1–1% by weight of a hydrocarbon liquid;

(b) a discontinuous phase comprising from 10–25% by weight of water and from 65–85% by weight of one or more soluble inorganic oxidizer salts, and;

(c) a dispersed density lowering ingredient to achieve a composition density of from 0.9–1.4 g/cc.

10. An explosive composition as claimed in claim 9 wherein the oxidizer salt comprises at least 55% by weight ammonium nitrate.

11. An explosive composition as claimed in claim 9 wherein the density lowering ingredient is selected from particulate void-containing materials and dispersed gas bubbles.

* * * * *